US007954938B2

(12) United States Patent
Perego

(10) Patent No.: US 7,954,938 B2
(45) Date of Patent: Jun. 7, 2011

(54) APPARATUS AND PROCESS FOR INK-JET PRINTING

(75) Inventor: Luciano Perego, Mezzago (IT)

(73) Assignee: Tapematic S.p.A., Ornago (IT)

( * ) Notice: Subject to any disclaimer, the term of this patent is extended or adjusted under 35 U.S.C. 154(b) by 1208 days.

(21) Appl. No.: 11/639,885

(22) Filed: Dec. 15, 2006

(65) Prior Publication Data

US 2007/0146458 A1 Jun. 28, 2007

(30) Foreign Application Priority Data

Dec. 22, 2005 (EP) ..... 05425906

(51) Int. Cl.
*B41J 2/01* (2006.01)

(52) U.S. Cl. ..... 347/102; 347/104

(58) Field of Classification Search ..... 347/102, 347/2, 104, 101, 16; 101/488; 219/216; 346/25

See application file for complete search history.

(56) References Cited

U.S. PATENT DOCUMENTS 5,181,081 A * 1/1993 Suhan ..... 356/394
5,335,594 A * 8/1994 Karlyn et al. ..... 101/35
5,451,130 A * 9/1995 Kempf ..... 414/27
5,456,169 A * 10/1995 Rohwetter et al. ..... 101/35
5,520,106 A * 5/1996 Karlyn et al. ..... 101/35
5,549,043 A * 8/1996 Tranin ..... 101/126
5,549,444 A * 8/1996 Dubuit ..... 414/796.7
5,730,048 A * 3/1998 Averill et al. ..... 101/37
5,967,676 A * 10/1999 Cutler et al. ..... 400/70
6,146,805 A * 11/2000 Yoshimura et al. ..... 430/125.5
6,248,804 B1 * 6/2001 Lutz ..... 523/160
6,312,123 B1 * 11/2001 Codos et al. ..... 347/102
6,412,907 B1 * 7/2002 Castelli et al. ..... 347/37
6,428,143 B2 * 8/2002 Irihara et al. ..... 347/43
6,550,882 B2 * 4/2003 Koitabashi et al. ..... 347/8
6,562,413 B1 * 5/2003 Morgavi ..... 427/466
6,672,694 B2 * 1/2004 Shimizu ..... 347/2
6,846,541 B1 * 1/2005 Oshima ..... 428/64.1
7,083,252 B2 * 8/2006 Yokoyama et al. ..... 347/23
7,134,749 B2 * 11/2006 Ben-Zur et al. ..... 347/101
7,137,696 B2 * 11/2006 Siegel ..... 347/102
7,178,898 B2 * 2/2007 Hoshino ..... 347/40
7,211,299 B2 * 5/2007 Siegel ..... 427/493
7,244,021 B2 * 7/2007 Arai ..... 347/102
7,407,277 B2 * 8/2008 Yoneyama ..... 347/102
7,498,065 B2 * 3/2009 Siegel ..... 427/558
7,510,277 B2 * 3/2009 Konno et al. ..... 347/102
7,562,957 B2 * 7/2009 Mills et al. ..... 347/15
7,567,266 B2 * 7/2009 Valley et al. ..... 347/224
2002/0012556 A1 1/2002 Niestrath
2003/0067499 A1 4/2003 Shimizu
2004/0189772 A1 * 9/2004 Arai ..... 347/102
2005/0104946 A1 5/2005 Siegel
2006/0038868 A1 * 2/2006 Otter ..... 347/102
2006/0066703 A1 * 3/2006 Kadomatsu et al. ..... 347/102

* cited by examiner

*Primary Examiner* — Stephen D Meier
*Assistant Examiner* — Leonard S Liang
(74) *Attorney, Agent, or Firm* — Pearne & Gordon LLP

(57) ABSTRACT

A process carried out by an ink-jet printing apparatus (1) comprises the steps of placing articles (3*a*) to be printed on a support (12) of an apparatus (1) further provided with a carriage (6) carrying at least one main print head (8) and at least one auxiliary head (11), and moving the support (12) and the carriage (6) relative to each other in at least one first ink-laying direction (X). The process is put into practice by carrying out the following steps in succession: laying the ink emitted from the auxiliary print head (11) to carry out printing of the articles (3*a*, 3*b*) with a background layer, drying the ink just laid by the auxiliary head (11) through a first drying device (14) disposed alongside the main head (8) and laying the ink emitted from the main head (8) to carry out decorations on the background layer.

44 Claims, 5 Drawing Sheets

APPARATUS AND PROCESS FOR INK-JET PRINTING

Figure 1:
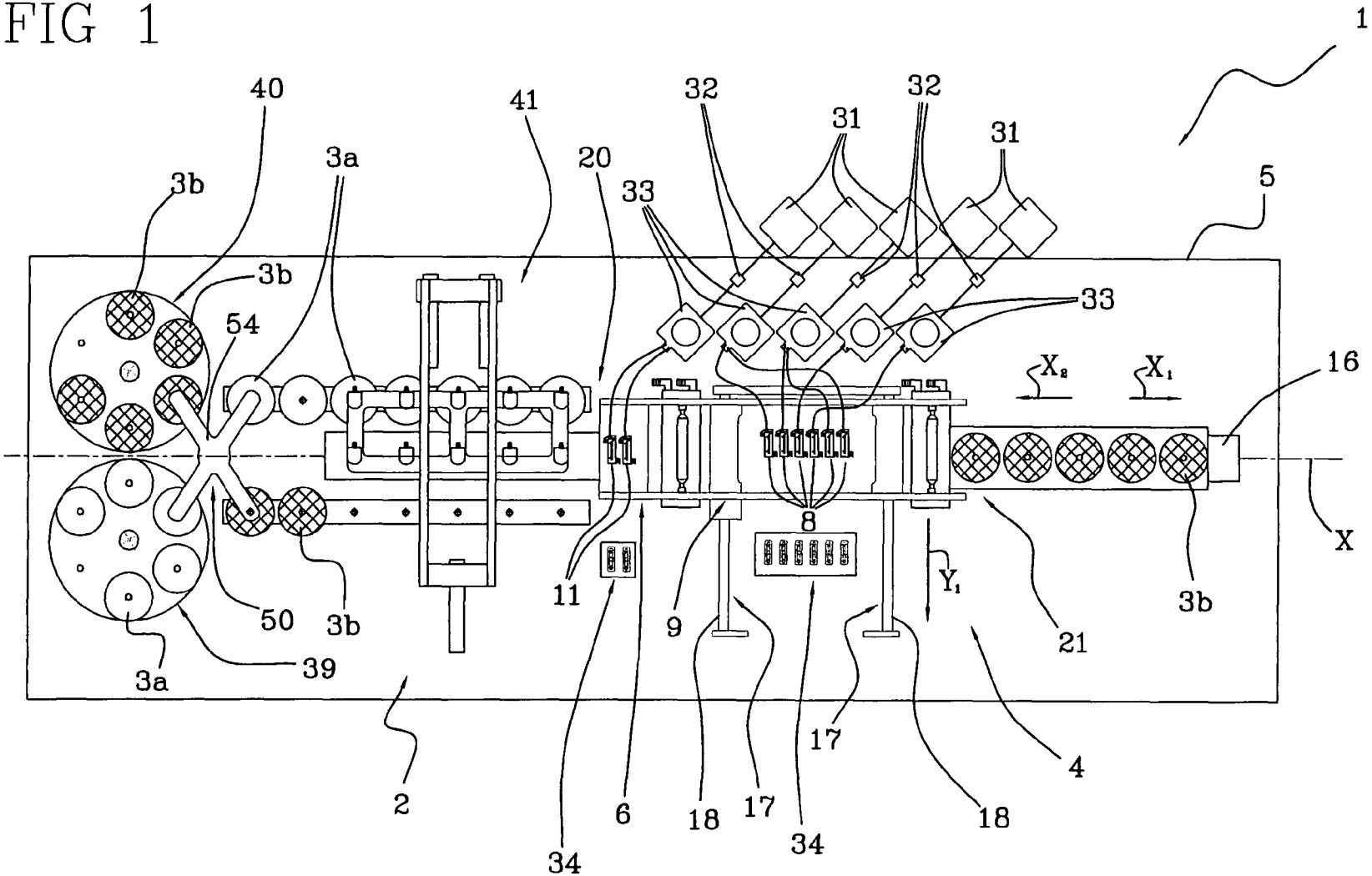

The present invention relates to an apparatus and a process for ink-jet printing.

In particular the present invention is advantageously but not exclusively concerned with decoration of surfaces of individual articles preferably having a major planar extension, such as optically readable discs, for instance compact discs (CD's) and digital versatile discs (DVD's), cards, magnetic cards and the like.

It is known that with reference to CD's and DVD's, in addition to inscriptions indicating their contents there are presently on these articles adorning decorations and figures applied to the face opposite to the one carrying the audio and/or video data track.

The decorations are for instance obtained either by a lithographic printing process, through which inscriptions and designs are drawn on a matrix and subsequently transferred onto the support to be decorated, or by a silk-screen printing process in which ink is caused to pass through a cloth or matrix, fastened to a frame and made impervious in the parts that are not to be printed. Both the above mentioned processes are very convenient for producing thousands or millions of pieces, where the matrix cost is fully amortised.

Nowadays, the ink-jet technology too is becoming increasingly more used in all application sectors of the graphic industry and in those sectors involving quick and quality printing processes to be however carried out on a reduced number of pieces. As compared with lithographic and silk-screen printing processes, ink-jet printing is much more flexible because it enables format changes (i.e. variations in the sizes and shape of the surface to be coloured and of the images) by substantially only acting on a terminal and operating the modifications via software.

The ink-jet printing apparatus of known type comprise a carriage that is shiftable in a reciprocating motion along a predetermined path and carries the print heads disposed in side by side relationship, usually four or six in number (depending on whether a four-colour printing process or a six-colour printing process is concerned). The colours used in the four-colour printing process are black, yellow, cyan and magenta. In the six-colour printing process light magenta and light cyan are added to the colours mentioned above. Movable under the carriage, in a direction transverse to the head motion, there is a supporting sheet or band carrying the articles to be printed, i.e. on which ink is to be laid.

After each passage of the print heads, or after a forward and back stroke of same, the supporting band moves one step forward to bring the articles under the predetermined carriage path. UV lamps are installed at the sides of the heads, said lamps being necessary for quick drying of the dye between one passage of the carriage and the subsequent one.

Disadvantageously, the materials of which the articles to be decorated are made are not adapted to direct laying of the decorations. In particular, CD's, DVD's, etc. have a reflecting surface on which a background colour, typically a white colour, is to be laid. This colour must be well dried before carrying out laying of the other colours of the decorations.

In the ink-jet printing apparatus of known type, in order to obtain formation of the background, first the articles during a first passage are all inked with the background colour contained in one or two heads for example, then the supporting band is inserted again and, by a second passage, the colours of the decorations are laid down possibly operating replacement of the heads. As a result the time for carrying out the whole procedure is doubled.

In addition, since the articles are all laid on a single supporting band moving forward intermittently, known apparatus are of great sizes and bulkiness because downstream and upstream of the printing carriage there must be sufficient room for receiving the band and possible devices for management of the latter.

It is an aim of the present invention to obviate the above drawbacks, by providing an ink-jet printing apparatus enabling speeding up of the printing operations on articles requiring a background layer to be first laid thereon.

It is a further aim of the present invention to propose an ink-jet printing apparatus less bulky than those of known type.

It is a still further aim of the invention to provide an apparatus that is flexible and can be easily adapted to the different formats of the articles to be decorated and to the different images to be laid on said articles.

In accordance with the present invention, the above and still further aims are achieved by an ink-jet printing apparatus and an inkjet printing process in accordance with the features recited in one or more of the claims.

Figure 1A:
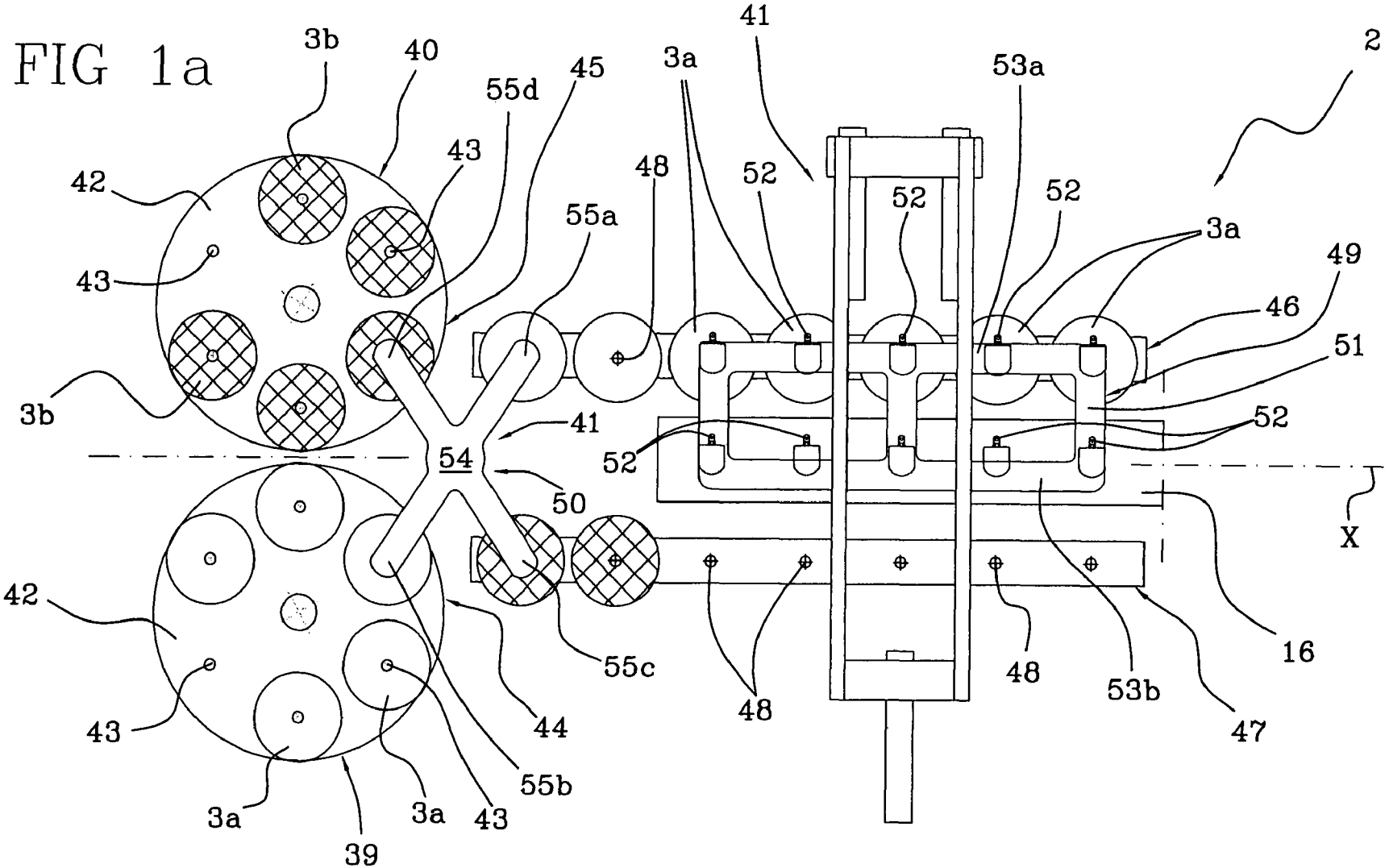
Figure 1B:
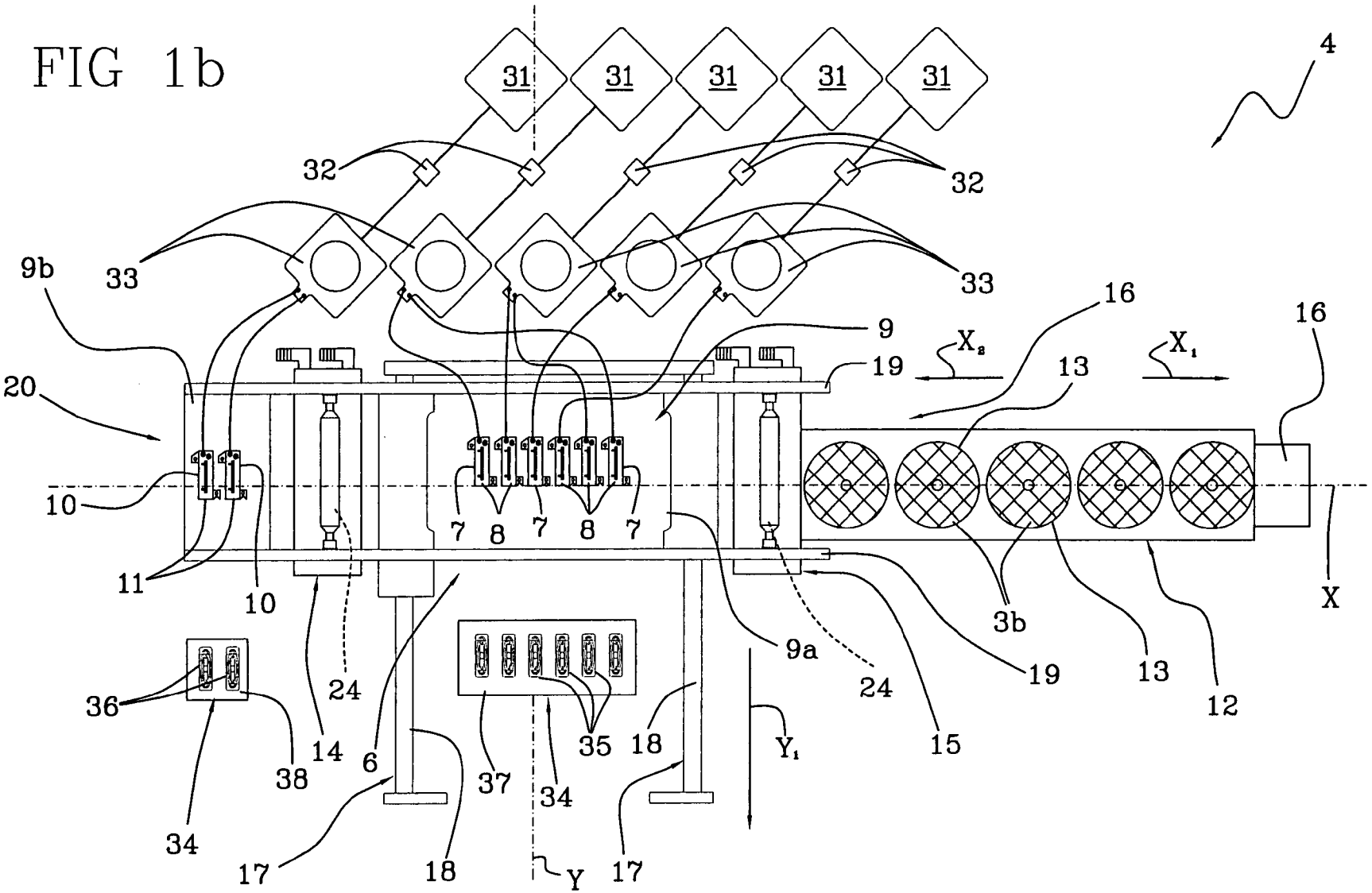
Figure 2:
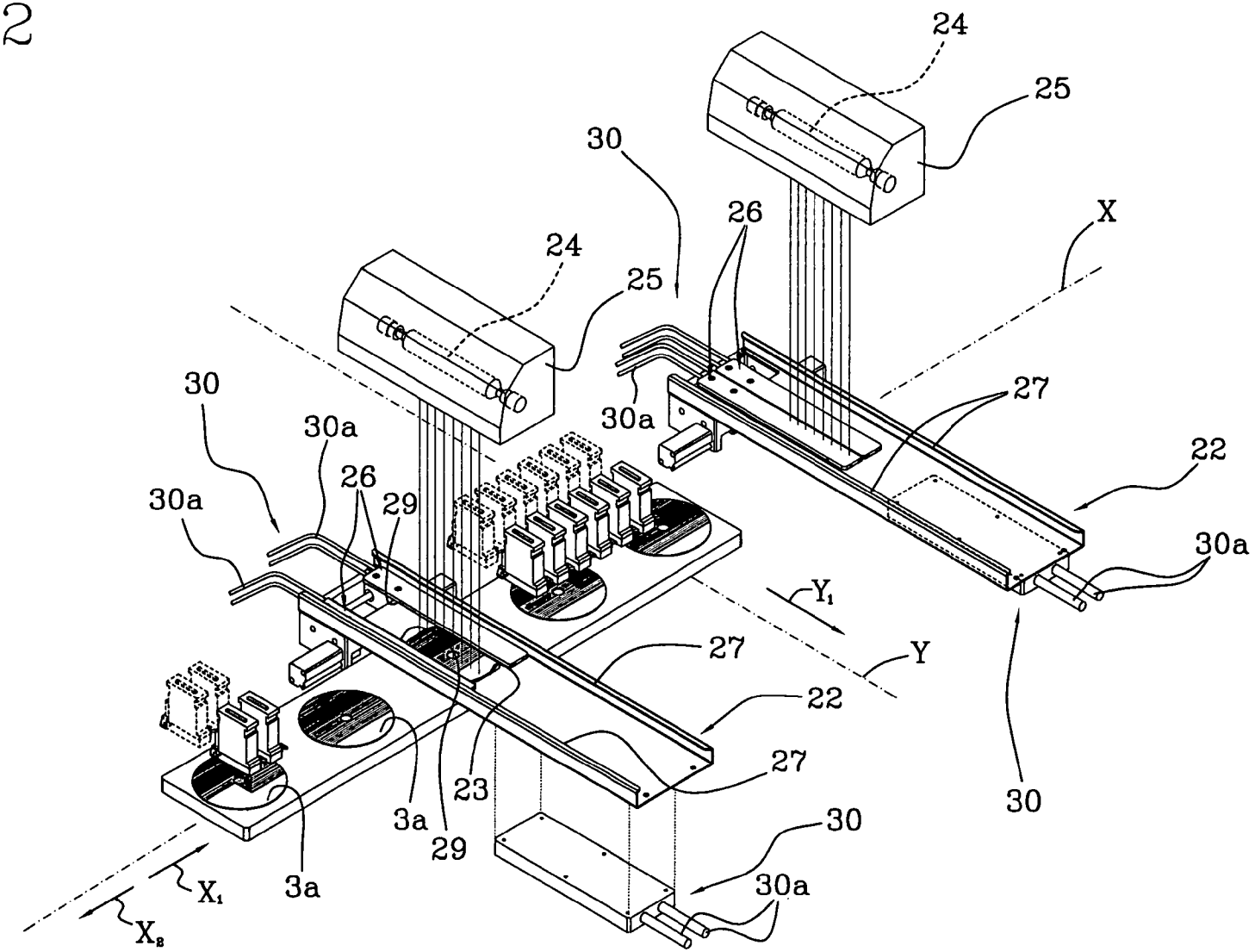
Figure 3:
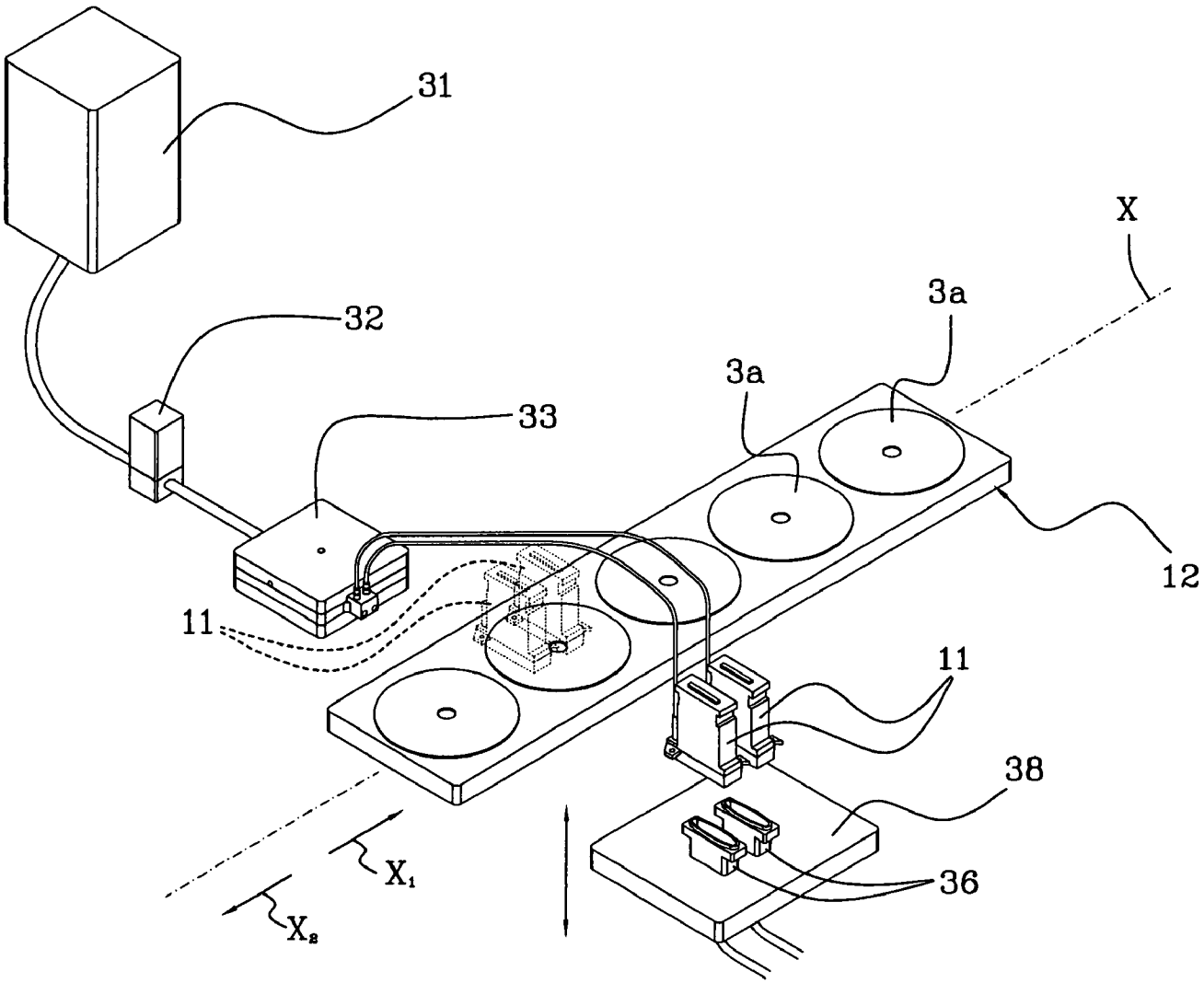

The present invention will be now described with reference to the accompanying drawings, depicting a preferred, but not exclusive, embodiment of an ink-jet printing apparatus, in which:

FIG. 1 is a diagrammatic top view of an ink-jet printing apparatus in accordance with the invention;

FIGS. 1*a* and 1*b* show respective enlarged portions of FIG. 1;

FIG. 2 is a perspective view of a first assembly of elements of the apparatus in FIG. 1; and FIG. 3 is a perspective view of a second assembly of elements of the apparatus seen in FIG. 1.

With reference to FIG. 1, an ink-jet printing apparatus in accordance with the present invention has been generally identified by reference numeral 1.

Apparatus 1 comprises a loading station 2 (FIG. 1*a*) for articles 3*a*, 3*b* and a print station 4 (FIG. 1*b*). These articles 3*a*, 3*b* are preferably, but not exclusively, of flattened shape, such as units for storage of optically readable data (CD's and DVD's, for example) and optically and/or magnetically readable cards, and have a surface to be printed, i.e. on which ink is to be laid, which is a reflecting surface or in any case a surface not adapted to be directly decorated without prior laying of a background colour. Both the above mentioned stations 2, 4 are installed on a base 5, diagrammatically shown in FIG. 1.

Apparatus 1 comprises a carriage 6 mounted on the base 5 and having at least one main seat 7 designed to receive a respective main print head 8. Preferably, carriage 6 is provided with a plurality of seats 7 disposed in side by side relationship and supporting the same number of main heads 8 containing coloured inks suitable for a four-colour or six-colour printing process. In the embodiment shown, six main seats 7 are formed in a steel plate 9 being part of carriage 6. The six main seats 7 each carry one head, i.e. in succession one with black, one with magenta, one with yellow, one with cyan, one with magenta and one with black, to execute a four-colour printing process as described in more detail in the following.

Carriage 6 further has at least one auxiliary seat 10 which supports an auxiliary print head 11 being spaced away from the main head or heads 8. In the embodiment shown, two auxiliary seats 10 are formed in plate 9 and both carry the same ink, to lay a background colour, usually white, onto the articles 3*a*, 3*b*.

A support 12 for the articles 3*a*, 3*b* is installed under carriage 6 and it has a plurality of housings 13 adapted to receive the articles 3*a*, 3*b* and dispose them in faced relationship with the main 8 and auxiliary 11 heads. Carriage 6 and support 12 are movable relative to each other in at least one first ink-laying direction "X". By ink-laying direction "X" it is intended the direction along which the relative, usually continuous, motion takes place during which the heads 8, 11 spray ink onto the articles 3*a*, 3*b*. Carriage 6 and support 12 are in addition movable relative to each other in a second direction "Y", perpendicular to the first one "X", to bring successive portions of the support 13 and the articles 3*a*, 3*b* under the print heads 8, 11 (FIG. 2). By second direction "Y" it is intended the direction along which the relative usually intermittent motion takes place during which the heads 8, 11 do not work and the articles 3*a*, 3*b* are translated, after each passage of the main heads 8, to successively bring the portions of articles 3*a* 3*b* still to be printed into the working space of the heads 8, 11.

The main heads 8 are disposed in mutual side by side relationship along the first direction "X". The two auxiliary heads 11 too are disposed in mutual side by side relationship but are not exactly aligned with the main heads 8. More particularly, the main seats 7 and auxiliary seats 10 are disposed mutually offset in the first direction "X". In fact, as viewed from FIG. 1*b*, the auxiliary seats 10 are more forward than the main seats 7 in the advancing way "$Y_1$" along the second direction "Y".

Advantageously, a first drying device 14 is disposed alongside the main seats 7 in the first direction "X" and is interposed between said main seats 7 and the auxiliary seats 10. In other words, the auxiliary seats 10 are placed on the side opposite to the main seats 7 with respect to the first drying device 14 along said first direction "X". The function of the first drying device 14 is to dry the ink just laid by the auxiliary head or heads 11 before laying of ink by the main heads 8, when the relative motion along the first direction "X" takes place in a first way "$X_1$" (FIG. 2).

Preferably, apparatus 1 further comprises a second drying device 15 disposed alongside the main seats 7 in the first direction "X" and on the opposite side relative to the first drying device 14, to dry the ink laid by the main heads 8.

According to an alternative embodiment not shown, apparatus 1 could also have at least one further auxiliary seat, intended for a further auxiliary print head and placed on the opposite side from the main seats 7 relative to the second drying device 15. In this case, the second drying device 15 would be also used to dry the ink just laid by the further auxiliary head before laying of ink by the main head or heads 8, when the relative motion along the first direction "X" takes place in a second way "$X_2$" (FIG. 2), opposite to the first way "$X_1$".

With reference to the accompanying figures showing the preferred embodiment, support 12 is advantageously movable relative to base 5 in the first ink-laying direction "X" while carriage 6 is movable relative to base 5 in the second direction "Y".

It is to be pointed out that the auxiliary print heads 11 and drying devices 14, 15 could be also implemented on an apparatus provided with traditional movements, i.e. reversed relative to those of the above description, in which support 12 is intermittently movable relative to base 5 in the second direction "Y" and carriage 6 is movable relative to base 5 in a reciprocating motion along the first direction "X".

Referring again to the preferred embodiment herein illustrated, the support 12 is defined by a tray provided with housings 13, each being suitably shaped to receive one of the articles 3*a*, 3*b*. As shown, the rectangular tray 12 has five housings 13 that are mutually aligned in the first direction "X" and adapted to receive the same number of CD's or DVD's having their faces to be printed turned upwardly.

A first guide 16 is mounted on base 5 and extends parallel to the first direction "X", to move support 12 in said first direction "X" by means of an electric motor, not shown in detail, of the linear type for example.

Mounted above the first guide 16 and tray 12 is a second guide 17 extending parallel to the second direction "Y" and supporting carriage 6. In detail, the second guide 17 is defined by a pair of parallel slides 18 on which carriage 6 slides like a runner, being moved by a second motor through a worm screw, for example.

The drying devices 14, 15 are installed on base 5, and carriage 6 has such a shape that it steps over them. In particular, plate 9 is divided into a first portion 9*a* lying between the first 14 and second 15 drying devices and carrying the main heads 8, and a second portion 9*b*, which is placed beyond the first drying device 14 towards the loading station 2 and carries the auxiliary heads 11. The two portions 9*a*, 9*b* are firmly linked to each other by two crosspieces 19 passing over said devices 14, 15.

The first guide 16 extends under carriage 6 and projects from both sides of the latter by a length sufficient to bear the tray 12, so that the articles 3*a*, 3*b* do not remain under the heads 8, 11 or the drying devices 14, 15. The support 12 is therefore movable between a first position, at which it lies in side by side relationship with a first side of the carriage 6 and is positioned in the loading station 2, and a second position at which it lies in side by side relationship with a second side 21 of the carriage 6 opposite to the first one 20.

As shown in detail in FIG. 2, the drying devices 14, 15 each comprise a plate-like structure 22 fixedly mounted to the base 5 above the first guide 16, so that between the first guide 16 and the plate-like structure 22 there is room enough for passage of tray 12. The plate-like structure 22 mainly extends parallel to the second direction "Y" and has a through window 23 facing the first guide 16, which window can be reclosed. A lamp 24, preferably a ultraviolet (UV) light lamp, is installed over the window 23 and within a lamp-holding box 25 open towards the window 23 itself. The box 25 is installed on carriage 6 and moved by said carriage 6 in the second direction "Y". During this movement, the box 25 slides on the plate-like structure 22. In this way, the lamp 14 follows the heads 8, 11 in such a manner that its central portion emitting the maximum radiation amount is maintained exactly on the just printed region to be dried.

In accordance with an alternative embodiment not shown, the box 25 and lamp 24 contained therein are fixed relative to the base 5 and the plate-like structure 22 whereas carriage 6 slides thereon. In this embodiment, the length of the central portion of lamp 24 is sufficient to cover the whole path of the heads 8, 11 in the direction "Y" perpendicular to the printing direction "X".

The drying devices 14, 15 further comprise at least one wall 26 that is movable between a closed position, to prevent the UV radiation from being sent out, and an open position to enable exit of said UV radiation so that articles 3 are irradiated. In more detail, although in FIG. 2, for the sake of clarity, each lamp 24 has been shown spaced away from the respective plate-like structure 22, the lower edges of box 25 are actually disposed between the longitudinal flaps 27 of the plate-like structure 22, very close to window 23. The box 25 slides between the longitudinal flaps 27 of the plate-like structure 22 together with carriage 6 along the second direction "Y". In addition, window 23 can be reclosed by means of two walls 26 driven by pneumatic actuators 28, said walls 26 being movable between a closed position at which respective mutually facing edges 29 lie against each other, and an open position at which these edges 29 are mutually spaced apart.

Preferably, in order to avoid the plate-like structures 22 and movable walls 26 becoming too hot, in particular when the window 23 is closed, they are both provided with liquid cooling circuits 30. These circuits 30 are defined by ducts internal to the movable walls 26 and are fed with cooling liquid, preferably water, through pipes 30*a*.

The heads 8, 11 are fed with ink through suitable flexible ducts, from tanks 31, preferably by interposition of an on-off valve and a metering/regulating device 33 capable of maintaining the ink feeding pressure substantially constant and equal to the atmospheric pressure (for the sake of simplicity, FIG. 3 shows one tank alone feeding two heads). In the embodiment shown which is provided with two auxiliary heads 11 for the background colour (white colour for example) and six colour heads as above specified, tanks 31 are five in number, the same number as the colours used, i.e. white, black, magenta, yellow and cyan (FIG. 1*b*).

The print station 2 is finally provided with a device 34 for cleaning the heads 8, 11 which preferably comprises a first series of mouths 35, each to be engaged with a main head 8, and a second series of mouths 36, each to be engaged with an auxiliary head 11 (FIGS. 1 and 1*b*). Mouths 35 of the first series are mounted on a first movable plate 37 placed on base 5 between the two slides 18 and along the motion direction of the main heads 11 and mouths 36 of the second series are mounted on a second movable plate 38 placed on base 5 along the motion direction of the auxiliary heads 11. Carriage 6 is further movable on the slides 18 until it brings the heads 8, 11 in superposed relationship with the mouths 35, 36, so that the plates 37, 38, being lifted by means of suitable motors not shown, bring said mouths 35, 36 close to the nozzles of the heads 8, 11 (for more simplicity FIG. 3 only shows the auxiliary heads, in solid line in the cleaning position and in chain line in the printing position). Said mouths 35, 36 are connected to an aspirator and/or a compressed-air source for suction or removal of possible ink laid on the head nozzles.

Referring particularly to FIG. 1*a*, the loading station 2 comprises a first magazine 39 designed to contain articles 3*a* and a second magazine 40 designed to contain articles 3*b*. Handling means 41 is able to shift the articles to be printed 3*a* from the first magazine 39 to tray 12 and to shift the printed articles 3*b* from tray 12 to the second magazine 40. In more detail, each of said first and second magazines 39, 40 consists of a revolving table 42 supporting stacks of articles 3*a*, 3*b* disposed close to the edge of table 42 and angularly spaced apart. In the instance shown, the articles of each stack are slipped on a rod 43. The table 42 of the first magazine 39 rotates by intermittence to successively bring the stacks of articles to be printed 3*a* to a picking-up area 44 while the table 42 of the second magazine 40 rotates by intermittence to successively bring the empty rods 43 to an area 45 for recovery of the already printed articles 3*b*.

The handling means 41 comprises a first 46 and a second 47 conveyor belts that are parallel and disposed in side by side relationship on opposite sides of the first guide 16 projecting from the first side 20 of carriage 6. The two belts 46, 47 therefore also lie in side by side relationship with the support 12 when the latter is in the loading station 2 (which configuration is not shown). An upper stretch of each of the belts 46, 47 is provided with seats 48 for articles 3*a*, 3*b*, which seats, in the embodiment shown, are defined by pins each of which is adapted for fitting in the central hole of a CD or DVD. Each pin 48 of the first belt 46 is aligned with a homologous pin 48 of the second belt 47 along a direction parallel to the second movement direction "Y" of carriage 6. In addition, when tray 12 lies in the loading station 2, to receive the articles to be printed 3*a*, each housing 13 of tray 12 is aligned with two homologous pins 48 along said direction.

First transfer means 49 carries out shifting of the articles to be printed 3*a* from the first conveyor belt 46 to support 12 and shifting of the printed articles 3*b* from support 12 to the second conveyor belt 47. Second transfer means 50 is able to move the articles to be printed 3*a* from the first magazine 39 to the first conveyor belt 46 and the printed articles 3*b* from the second conveyor belt 47 to the second magazine 40.

The first transfer means 49 comprises a frame 51 that is movable in parallel to the second direction "Y" and is provided with grip ends 52, of the pneumatic type for example, facing downwards, i.e. towards the belts 46, 47 and the first guide 16. Said frame 51 is able to carry out a simultaneous shifting of the articles to be printed 3*a* from the first conveyor belt 46 to the support 12 and of the printed articles 3*b* from the support to the second conveyor belt 47. For this purpose, the frame has a first 53*a* and a second 53*b* bars parallel to the first guide 16 and the conveyor belts 46, 47, said bars being rigidly connected and being each provided with a series of vertically movable grip ends 52. Each grip end 52 of the first bar 53*a* is aligned with a homologous grip end 52 of the second bar 53*b* in a direction parallel to the second movement direction "Y" of carriage 6. The two series of grip ends 52 in addition are mutually and rigidly spaced apart by a distance corresponding to the distance existing between the seats 48 of each of the conveyor belts 46, 47 and the housings 13 of tray 12, when this support is in the loading station 2. In this way, when the first bar 53*a* is over the first conveyor belt 46 with each grip end 52 in superposed relationship with an article to be printed 3*a* and ready to pick it up, the second bar 53*b* is in superposed relationship with tray 12 with each grip end 52 on a printed article 3*b* and ready to pick it up. Furthermore, when the first bar 53*a* is moved over tray 12 due to movement of frame 51, each grip end 52 is placed over an empty housing 13, to lay down an article to be printed 3*a* thereinto, and the second bar 53*b* is placed over the second conveyor belt 47 with each grip end 52 superposed on a seat 48 and ready to lay down a printed article 3*b* thereon. In the preferred embodiment, each belt 46, 47 on its upper stretch has seven seats 48, five of which are aligned with the housings 13 of tray 12 and two of which are disposed beyond the first guide 16, close to the magazines 39, 40. In particular, one end portion of the first conveyor belt 46 is close to the second magazine 40 and one end portion of the second conveyor belt 47 is close to the first magazine 39.

The second transfer means 50 comprises a rotating structure 54 interposed between the magazines 39, 40 and the end portions of the conveyor belts 46, 47. Said structure 54 is cross shaped and is provided with four arms and four grip ends 55*a*, 55*b*, 55*c*, 55*d* that are vertically movable to simultaneously move an article to be printed 3*a* from the first magazine 39 to the first conveyor belt 46 and a printed article 3*b* from the second conveyor belt 47 to the second magazine 40. In particular, the cross structure 54 is movable between two positions angularly offset by 180°. In both positions, a first grip end 55*a* of structure 54 lies superposed on seat 48 placed on the end portion of the first conveyor belt 46, a second grip end 55*b* diametrically opposite to the first one lies superposed on one of the stacks of articles to be printed 3*a* placed on the first magazine 39, a third grip end 55*c* lies superposed on seat 48 placed on the end portion of the second conveyor belt 47 and a fourth grip end 55*d* diametrically opposite to the third one 55*c*, lies superposed on one of the stacks of printed articles 3*b* placed on the second magazine 40.

All the apparatus movements are governed by an electronic control unit that is programmed via software, based on the designs to be executed and the types of articles to be printed.

In use, an article 3*a* to be printed lying on top of the stack placed close to the picking up area 44 of the first magazine 39 is picked up by the second grip end 55*b* of structure 54 and brought, through a 180° rotation, onto the seat 48 at the end portion of the first conveyor belt 46. This rotation brings the first grip end 55*a* close to the picking up area 44 where it picks up a subsequent article. The first conveyor belt 46 moves by one step towards the print station 4 to bring a subsequent empty seat 48 onto its end portion, so that a further 180° rotation of structure 54 in the opposite way causes loading of the subsequent article onto said first belt 46. Through repetition of this operation, loading of the seven seats 48 of the upper stretch of the first conveyor belt 46 is carried out.

Simultaneously with the above mentioned first rotation, the third grip end 55*c* picks up a printed article 3*b* from the end portion of the second conveyor belt 47 and takes it onto the second magazine 40. This rotation brings the fourth grip end 55*d* that lay over the recovery area 45 of the second magazine 40, onto the end portion of the second conveyor belt 47 where it picks up a subsequent already printed article 3*b*.

The second conveyor belt 47 moves by one step away from the print station 4 to take a subsequent printed article 3*b* onto its end portion, so that a further 180° rotation of structure 54 in the opposite way unloads this subsequent article 3*b* onto the second magazine 40.

When the second conveyor belt 47 has been partly emptied, the frame 51 picks up five articles 3*a* from the first belt 46 and brings them onto the tray 12 that is stationary in the loading station 2. Simultaneously, the frame 51 shifts five already printed articles 3*b* present on the tray 12, onto the second belt 47.

Tray 12 is moved in the first direction "X" between the first and second positions for ink laying. In particular, with reference to FIG. 2, during motion in the first way "$X_1$", the auxiliary heads 11 lay the background ink. Subsequently, still during motion in the first way "$X_1$", the partly printed articles 3*a*, 3*b* move under the UV lamp of the first device 14 for drying while the movable walls 26 are open. After drying, the main heads 8 lay the colours necessary for decoration onto the background ink. Finally, the second device 15 carries out drying of the decorative layer as well. During motion in the opposite way "$X_2$" carriage 6 remains in the same position so that the main heads 8 lay further colour on the same already coloured band to complete decoration. When a full forward and reverse cycle has been completed, the carriage moves on by one step along the second direction "Y" to carry out printing on a subsequent band of articles 3*a*, 3*b* (two successive positions of heads 8, 11 are shown in FIG. 1, in chain and solid line, respectively). The number of forward and reverse cycles depends on the sizes of the articles 3*a*, 3*b* and the sizes of the nozzles of heads 8, 11. It will be appreciated that the auxiliary heads 8 are more forward relative to the main heads 8 in the advancing way "$Y_1$" along the second direction "Y" to ensure laying of the decoration colours on the already laid background and not directly on the reflecting surface of the CD (FIG. 2).

In the embodiment shown, the background colour is laid only during the forward motion in the first way "$X_1$". If also the further auxiliary head, not shown, is present, the background colour will be laid during both the forward and reverse strokes, in the second way "$X_2$". In this case, carriage 6 would move on by one step along the second direction "Y", to print a subsequent band of articles 3*a*, 3*b*, after each forward stroke and after each reverse stroke. The sequence of the printing and drying steps would be the same during the forward and the reverse strokes.

Advantageously, after each passage of the whole tray 12, the walls 26 are closed to avoid useless radiation of the UV lamps.

During printing, the rotating structure 54, through its third and fourth grip ends 55*c*, 55*d*, unloads the printed articles 3*b* from the second conveyor belt 47 and takes them onto the second magazine 40, and simultaneously the first and second grip ends 55*a*, 55*b* load other articles to be printed 3*a* onto the first belt 46.

It will be recognised that the present apparatus having the above described movements could be provided with the main heads alone and, optionally, with the drying device/devices, without the seats for the auxiliary heads suitable for laying of the background ink, so as to carry out printing of articles that do not require previous formation of a background.

The present invention achieves the intended purposes and has important advantages.

First of all, the apparatus and method of the invention enable printing of articles with a background layer and a subsequent decoration in a completely automatic manner.

In addition, this type of double-layer printing is carried out quickly in one working cycle alone, without the same articles being loaded twice into the machine in order to submit them to successive treatments.

Furthermore, the invention enables printing processes on different articles and with different designs to be managed with great flexibility, by merely intervening on the printing program via software.

The apparatus is also compact and does not take up much room, because the magazines too are implemented within the apparatus base.

The invention claimed is:

1. An ink-jet printing apparatus, comprising a base, a carriage mounted on the base and having at least one main seat for a respective main print head, a support for articles to be printed, installed under the carriage; the carriage and the support being movable relative to each other in at least one first ink-laying direction, wherein it further comprises a first drying device disposed alongside said at least one main seat in the first direction, and at least one auxiliary seat placed on the carriage and intended for at least one respective auxiliary print head located on the side opposite to the main seat relative to the first drying device, to dry the ink just laid by the auxiliary head before laying of ink by the main head;

wherein the carriage and the support are movable relative to each other in a second direction perpendicular to the first direction, to bring subsequent portions of the support and the articles under the print heads;

wherein the support is movable relative to the base in the first ink-laying direction;

wherein the carriage is movable relative to the base in the second direction.

2. An apparatus as claimed in claim 1, wherein it further comprises a second drying device disposed alongside said at least one main seat in the first direction and on the opposite side relative to the first drying device.

3. An apparatus as claimed in claim 2, wherein it further comprises at least one further auxiliary seat for a further auxiliary print head placed on the side opposite to the main seat relative to the second drying device and along the first direction, to dry the ink just laid by the further auxiliary head before laying of ink by the main head.

4. An apparatus as claimed in claim 1, wherein the carriage has a plurality of main seats disposed in mutual side by side relationship in the first direction to receive an equal number of main print heads.

5. An apparatus as claimed in claim 4, wherein the main heads contain coloured inks.

6. An apparatus as claimed in claim 1, wherein the auxiliary heads contain a background ink.

7. An apparatus as claimed in claim 1, wherein said at least one main seat and at least one auxiliary seat are disposed mutually offset along the first direction.

8. An apparatus as claimed in claim 1, wherein said at least one auxiliary seat is disposed more forward than said at least one main seat relative to an advancing way in the second direction.

9. An apparatus as claimed in claim 1, wherein the support has a tray provided with housings that are each designed to receive one of the articles.

10. An apparatus as claimed in claim 9, wherein the housings are mutually aligned in the first direction.

11. An apparatus as claimed in claim 1, wherein it comprises at least one first guide mounted on the base and extending parallel to the first direction and a first motor connected to the support to move said support on said first guide in said first direction.

12. An apparatus as claimed in claim 11, wherein it comprises at least one second guide mounted on the base and extending parallel to the second direction and a second motor connected to the carriage to move said carriage on said second guide in said second direction.

13. An apparatus as claimed in claim 12, wherein said at least one second guide comprises a pair of slides on which the carriage runs.

14. An apparatus as claimed in claim 11, wherein said first motor is a linear electric motor.

15. An apparatus as claimed in claim 1, wherein the drying devices are of the UV light type.

16. An apparatus as claimed in claim 15, wherein each drying device comprises at least one wall that is movable between a closed position to prevent the UV radiation from being sent out, and an open position to enable exit of said UV radiation and irradiation of the articles.

17. An apparatus as claimed in claim 16, wherein said drying devices each comprise a plate-like structure that is fixed relative to the base and a lamp-holding box integral with the carriage and facing the plate-like structure, said plate-like structure having a window that can be reclosed by the movable wall.

18. An apparatus as claimed in claim 1, wherein the support is movable between a first position at which it lies in side by side relationship with a first side of the carriage and a second position at which it lies in side by side relationship with a second side of the carriage opposite to the first one.

19. An apparatus as claimed in claim 18, wherein the support is movable in a reciprocating motion between the first and second positions during the ink-laying operation.

20. An apparatus as claimed in claim 18, wherein it further comprises a station for loading the articles onto the support.

21. An apparatus as claimed in claim 20, wherein in the first position the support is in the loading station of the articles.

22. An apparatus as claimed in claim 21, wherein the loading station comprises a first magazine designed to contain the articles to be printed, a second magazine designed to contain the printed articles and handling means to carry the articles to be printed from the first magazine to the support and the printed articles from the support to the second magazine.

23. An apparatus as claimed in claim 22, wherein the handling means comprises a first and a second conveyor belts disposed in side by side relationship on opposite sides of the support when said support is in the loading station; first transfer means for shifting of the articles to be printed from the first conveyor belt to the support and shifting of the printed articles from the support to the second conveyor belt; second transfer means to carry the articles to be printed from the first magazine to the first conveyor belt and the printed articles from the second conveyor belt to the second magazine.

24. An apparatus as claimed in claim 23, wherein each of the conveyor belts has a plurality of seats for the articles.

25. An apparatus as claimed in claim 23, wherein the first transfer means comprises a movable frame provided with grip ends for simultaneously shift the articles to be printed from the first conveyor belt to the support and the printed articles from the support to the second conveyor belt.

26. An apparatus as claimed in claim 23, wherein the second transfer means comprises a cross-shaped rotating structure provided with four grip ends, to simultaneously carry an article to be printed from the first magazine to the first conveyor belt and a printed article from the second conveyor belt to the second magazine.

27. An ink-jet printing process, comprising the steps of moving a support housing articles to be printed and a carriage supporting at least one main print head relative to each other, in at least one first ink-laying direction, to lay the ink emitted from said at least one main print head onto the articles, wherein, before laying of the ink emitted from said at least one main print head, it further comprises the steps of laying the ink emitted from at least one auxiliary head housed on the carriage and drying the ink just laid by said auxiliary head by means of a first drying device disposed alongside said at least one main head;

wherein it further comprises the step of moving the carriage and the support relative to each other in a second direction perpendicular to the first direction, to bring portions of the support and the articles in succession under the print heads;

wherein the step of moving the support and the carriage relative to each other in the first direction is carried out through shifting of the support in said first direction, wherein the step of moving the support and the carriage relative to each other in the second direction is carried out through shifting of the carriage in said second direction.

28. A process as claimed in claim 27, wherein the support and the carriage are moved relative to each other in said first direction in a reciprocating motion according to a first way or to a second way opposite to the first one.

29. A process as claimed in claim 28, wherein the step of laying the ink emitted from said at least one auxiliary head, the step of drying the ink just laid by said auxiliary head and the step of laying the ink emitted from said at least one main head are carried out during a motion in the first way.

30. A process as claimed in claim 29, wherein the step of laying the ink emitted from said at least one main head is also carried out during a motion in the second way.

31. A process as claimed in claim 29, wherein it further comprises the following steps carried out in sequence during motion in the second way: laying the ink emitted from at least one further auxiliary head housed in a further auxiliary seat of the carriage, drying the ink just laid by the further auxiliary head, by means of a second drying device disposed alongside said at least one main head, and laying the ink emitted from said at least one main print head.

32. A process as claimed in claim 27, wherein the auxiliary head or heads lay a background layer onto the articles .

33. A process as claimed in claim 32, wherein said at least one main head carries out decorations on the background layer.

34. A process as claimed in claim 32, wherein the auxiliary head or heads lay white ink.

35. A process as claimed in claim 32, wherein a plurality of main heads lay a plurality of coloured inks.

36. A process as claimed in claim 27, wherein the ink-drying step is carried out by irradiation of the articles with UV light.

37. A process as claimed in claim 27, wherein the articles have a planar extension.

38. A process as claimed in claim 27, wherein the articles are data storage discs.

39. A process as claimed in claim 27, wherein the articles are optically readable storage units, such as CD's and DVD's.

40. A process as claimed in claim 27, wherein the articles are cards.

41. An ink-jet printing apparatus, comprising:

a base, a carriage mounted on the base and having at least one main seat for a respective main print head, a tray provided with housings that are each designed to receive an article to be printed, said tray being installed under the carriage and movable relative to the base in a first ink-laying direction;

wherein the carriage further comprises a first drying device disposed alongside said at least one main seat in the first ink-laying direction;

wherein the carriage is movable relative to the base in a second direction perpendicular to the first ink-laying direction, to bring subsequent portions of the tray and the articles under the print heads;

wherein the tray is movable in a reciprocating motion between a first position and a second position opposite to the first one during the ink-laying operation.

42. An apparatus as claimed in claim 41, wherein it further comprises a station for loading the articles onto the tray and wherein in the first position the tray is in said loading station of the articles; wherein the loading station comprises a first magazine designed to contain the articles to be printed, a second magazine designed to contain the printed articles and handling means to carry simultaneously the articles to be printed from the first magazine to the tray and the printed articles from the tray to the second magazine.

43. An apparatus as claimed in claim 42, wherein the handling means comprises a first and a second conveyor belts disposed in side by side relationship on opposite sides of the tray when said tray is in the loading station; a movable frame provided with grip ends for simultaneously shift the articles to be printed from the first conveyor belt to the tray and the printed articles from the tray to the second conveyor belt.

44. An apparatus as claimed in claim 43, wherein the handling means comprises a cross-shaped rotating structure provided with four grip ends, to simultaneously carry an article to be printed from the first magazine to the first conveyor belt and a printed article from the second conveyor belt to the second magazine.

* * * * *